350-336 SR
PTH29 XR 4,205,298

United States Patent [19]
Shapiro et al.
[11] 4,205,298
[45] May 27, 1980

[54] RESISTOR MATERIAL, RESISTOR MADE THEREFROM AND METHOD OF MAKING THE SAME

[75] Inventors: Howard E. Shapiro, Philadelphia; Kenneth M. Merz, Gladwyne, both of Pa.

[73] Assignee: TRW, Inc., Cleveland, Ohio

[21] Appl. No.: 962,233

[22] Filed: Nov. 20, 1978

[51] Int. Cl.² ..... H01C 1/012
[52] U.S. Cl. ..... 338/308; 29/610 R; 252/518
[58] Field of Search ..... 338/306-309; 252/518, 512; 29/610; 427/101-103, 96, 376 R, 376 A, 376 B, 376 C, 398; 106/54

[56] References Cited

U.S. PATENT DOCUMENTS

| | | | |
|---|---|---|---|
| 3,394,087 | 7/1968 | Huang et al. | 252/512 |
| 4,053,866 | 10/1977 | Merz et al. | 338/309 |

OTHER PUBLICATIONS

Merz, et al., Proceedings, Electronic Components Conference, "Nitride-Metal Resistive Glazes", pp. 292-298, 1968.

Shapiro, et al., Twenty-Fifth Electronic Components Conference, Refractory Metal Glazes for Thick Film Network, pp. 331-336, May 12-14, 1975.

*Primary Examiner*—C. L. Albritton
*Attorney, Agent, or Firm*—Jacob Trachtman

[57] ABSTRACT

A vitreous enamel resistor material comprising a mixture of a vitreous glass frit and fine particles of tantalum nitride ($Ta_2N$). The vitreous enamel resistor material may also include fine particles selected from boron, tantalum, silicon, zirconium dioxide ($ZrO_2$), and magnesium zirconate ($MgZrO_3$). An electrical resistor is made from the resistor material by applying the material to a substrate and firing the coated substrate to a temperature at which the glass melts. Upon cooling, the substrate has on a surface thereof a film of glass having the tantalum nitride particles and particles of the additive material, if used, embedded therein and dispersed therethroughout.

25 Claims, 1 Drawing Figure

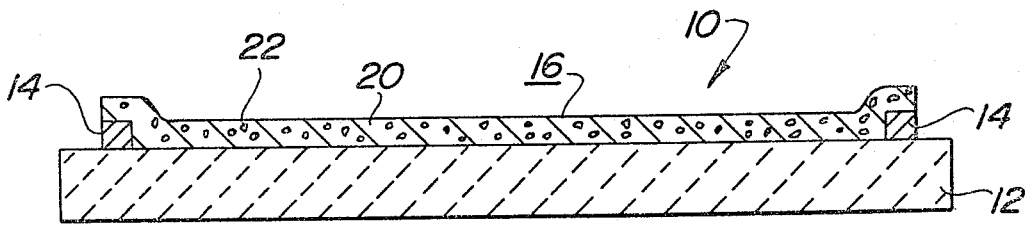
10
22
20
16
14
14
12

RESISTOR MATERIAL, RESISTOR MADE THEREFROM AND METHOD OF MAKING THE SAME

The present invention relates to a resistor material, resistors made from the material, and a method of making the same. More particularly, the present invention relates to a vitreous enamel resistor material which provides a resistor having a wide range of resistance values, and low temperature coefficient of resistance, and which is made from relatively inexpensive materials.

A type of electrical resistor material which has recently come into commercial use is a vitreous enamel resistor material which comprises a mixture of a glass frit and finely divided particles of an electrical conductive material. The vitreous enamel resistor material is coated on the surface of a substrate of an electrical insulating material, usually a ceramic, and fired to melt the glass frit. When cooled, there is provided a film of glass having the conductive particles dispersed therein.

Since there is a need for electrical resistors having low resistance as well as a wide range of resistance values, it is desirable to have vitreous enamel resistor materials with properties which allow the making of such resistors and also providing low resistance values. However, it is also desirable that such resistor materials have a low temperature coefficient of resistance so that the resistors are relatively stable with respect to changes in temperature. Heretofore, the resistor materials which had these characteristics generally have utilized the noble metals as the conductive particles and were therefore relatively expensive.

It is, therefore, an object of the present invention to provide a novel resistor material and resistor made therefrom.

It is another object of the present invention to provide a novel vitreous enamel resistor material and a resistor made therefrom.

It is still a further object of the present invention to provide a vitreous enamel resistor material which provides resistors having low resistance values as well as a wide range of resistance values, and relatively low temperature coefficients of resistance.

It is another object of the present invention to provide a vitreous enamel resistor material which provides resistors having low resistance values as well as a wide range of resistances, and relatively low temperature coefficients of resistance, and which material is relatively inexpensive and compatible with inexpensive copper and highly stable nickel terminations.

Other objects will appear hereinafter.

These objects are achieved by a resistor material comprising a mixture of a glass frit and a conductive phase provided by finely divided particles of tantalum nitride ($Ta_2N$). The conductive phase of the resistor material may also include finely divided particles selected from boron, nickel, silicon, tantalum, zirconium dioxide ($ZrO_2$), and magnesium zirconate ($MgZrO_3$), in an amount of up to approximately 100% by weight of the tantalum nitride ($Ta_2N$) particles. Although resistors have been made of tantalum nitride (TaN) and tantalum as described in U.S. Pat. No. 3,394,087 dated July 23, 1968, and entitled Glass Bonded Compositions Containing Refractory Metal Nitrides And Refractory Metal, such resistors are not compatible with nickel terminations required for providing stability under high firing conditions.

The invention accordingly comprises a composition of matter and the product formed therewith possessing the characteristics, properties, and the relation of components which are exemplified in the composition hereinafter described, and the scope of the invention is indicated in the claims.

For a fuller understanding of the nature and objects of the invention, reference should be had to the following detailed description taken in connection with the accompanying drawing in which:

The FIGURE is a sectional view of a portion of a resistor made with the resistor material of the present invention.

In general, the vitreous enamel resistor material of the present invention comprises a mixture of a vitreous glass frit and a conductive phase of fine particles of tantalum nitride ($Ta_2N$). The tantalum nitride ($Ta_2N$) is present in the resistor material in the amount of about 29% to about 78% by weight. The conductive phase of the resistor material may also include as additives boron, nickel, silicon, tantalum, zirconium dioxide ($ZrO_2$), or magnesium zirconate ($MgZrO_3$), in an amount up to approximately 100% by weight of the tantalum nitride ($Ta_2N$) particles. Each of the these additives generally increases the sheet resistivity of the resistor material.

The glass frit used may be any of the well known compositions used for making vitreous enamel resistor compositions and which has a melting point below that of the tantalum nitride ($Ta_2N$). However, it has been found preferably to use a borosilicate frit, and particularly an alkaline earth borosilicate frit, such as barium, magnesium or calcium borosilicate frit. The preparation of such frits is well known and consists, for example, of melting together the constituents of the glass in the form of the oxides of the constituents, and pouring such molten compositions into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

Tantalum nitride ($Ta_2N$) can be obtained commercially or made by placing elemental tantalum powder in a refractory boat and heat treating it in a nitrogen atmosphere up to a maximum temperature within the range of 600° C. to 1000° C. for a one hour cycle.

The resistor material of the present invention is preferably made by mixing together the glass frit and the particles of tantalum nitride ($Ta_2N$) in the appropriate proportions. Any additive material if used, is also added to the mixture. The mixing is preferably carried out by ball milling the ingredients in an organic medium such as butyl carbitol acetate.

To make a resistor with the resistor material of the present invention, the resistor material is applied to a uniform thickness on the surface of a substrate to which terminations such as copper or nickel thick film terminations have been screened and fired. The substrate may be a body of any material which can withstand the firing temperature of the resistor material. The substrate is generally a body of an insulating material, such as ceramic, glass, procelain, steatite, barium titanate, or alumina. The resistor material may be applied on the substrate by brushing, dipping, spraying, or screen stencil application. The substrate with the resistor material coating is then fired in a conventional furnace at a temperature at which the glass frit becomes molten. The resistor material is preferably fired in an inert atmosphere, such as argon, helium or nitrogen. The particular firing temperature used depends on the melting temperature of the particular glass frit used. When the substrate and resistor material are cooled, the vitreous enamel hardens to bond the resistance material to the substrate.

As shown in the FIGURE of the drawing, a resistor of the present invention is generally designated as 10, and comprises a ceramic substrate 12 having on its surface a pair of spaced termination layers 14 of a termination material, and a layer of resistor material of the present invention coated and fired thereon. The resistor material layer 20 comprises a film of glass 16 containing the finely divided particles 22 of tantalum nitride ($Ta_2N$) and any additive used, embedded in and dispersed throughout the glass.

The following examples are given to illustrate certain preferred details of the invention, it being understood that the details of the examples are not to be taken as in any way limiting the invention thereto.

EXAMPLE I

Tantalum nitride ($Ta_2N$) particles were made by heating tantalum particles in a nitrogen ($N_2$) atmosphere to a maximum temperature of 900° C. over a one hour cycle. The tantalum particles were manufactured by NCR, Inc. of Newton, Massachusetts and designated as grade SGQ-2. Batches of a resistor material were made by mixing together and ball milling for 72 hours powdered tantalum nitride ($Ta_2N$) particles and a glass frit of the composition of by weight 42% barium oxide (BaO), 24% boron oxide ($B_2O_3$), and 34% silica ($SiO_2$). Each batch contained a different amount of the tantalum as shown in Table I. Each of the batches was ball milled in butyl carbitol acetate.

After removing the liquid vehicle from each batch, the remaining mixture was blended with a screening vehicle which comprised by weight, 2% ethyl cellulose, 98% Texanol ester alcohol, except where otherwise indicated. The resultant resistor materials were screen stenciled onto ceramic substrates having on a surface thereof spaced terminations of copper glaze designated ESL 2310 of Electro Science Laboratories, Inc., Pennsauken, New Jersey, which were previously applied and fired at 950° C. After being dried at 150° C. for 10 to 15 minutes, the coated substrates were then fired in a conveyor furnace at 1000° C. over a ½ hour cycle in a nitrogen atmosphere. The resultant resistors were measured for resistance values and tested for temperature coefficents of resistance. The results of these tests are shown in Table I, with each result being the average value obtained from the testing of a plurality of resistors of each batch.

TABLE 1

| | | | |
|---|---|---|---|
| Conductive Phase (volume %) | 7.5 | 10 | 20 |
| Tantalum Nitride (weight %) | 29* | 36** | 56 |
| Resistance (ohms/square) | 9000 | 3200 | 4200 |

TABLE 1-continued

| | | | |
|---|---|---|---|
| Temperature coeff. of Resistance (PPM/°C.) | | | |
| +150° C. | 324 | −117 | ∓93 |
| −55° C. | 383 | −138 | ±74 |

*Screening vehicle, by weight, 39% butyl methacrylate and 61% butyl carbitol acetate.

**Tantalum particles designated grade SGV-4 were used.

EXAMPLE II

Batches of resistor material were made in the same manner as described in EXAMPLE I, except that they contained the amounts of tantalum nitride ($Ta_2N$) shown in Table II, and the tantalum nitride ($Ta_2N$) particles were made by nitriding the tantalum powder at 700° C., 800° C. and 900° C. Resistors were made from the batches of resistor materials in the same manner as described in EXAMPLE I, except that the screening vehicle comprised by weight, 39% butyl methacrylate, and 61% butyl carbitol acetate. The results of testing the resistors are shown in Table II.

TABLE II

| | | | |
|---|---|---|---|
| Conductive Phase (volume %) | 8 | 8 | 7.5 |
| Tantalum Nitride (weight %) | 30* | 30* | 29 |
| Nitriding Temp. (°C.) | 700 | 800 | 900 |
| Resistance (ohms/square) | 28,000 | 4,600 | 9,000 |
| Temperature coeff. of Resistance (PPM/°C.) | | | |
| +150° C. | −1283 | 350 | 324 |
| −55° C. | −2555 | 460 | 383 |

*Resistor glaze fired at 1050° C.

EXAMPLE III

Batches of resistor material were made in the same manner as described in EXAMPLE I, except that they contained the amounts of tantalum nitride ($Ta_2N$) shown in Table III, and the tantalum nitride ($Ta_2N$) particles were made by nitriding grade SGV-4 tantalum powder at 600° C., 900° C. and 1000° C. Resistors were made from the batches of resistor materials in the same manner as described in EXAMPLE I. The results of testing the resistors are shown in Table III.

TABLE III

| | | | |
|---|---|---|---|
| Conductive Phase (volume %) | 10* | 10 | 10.5* |
| Tantalum Nitride ($Ta_2N$) (weight %) | 36 | 36 | 37 |
| Nitriding Temp. (°C.) | 600 | 900 | 1000 |
| Resistance (ohms/square) | >10M | 3200 | 930 |
| Temperature coeff. of Resistance (PPM/°C.) | | | |
| +150° C. | — | −117 | 608 |

TABLE III-continued

| | | | |
|---|---|---|---|
| −55° C. | — | −138 | 702 |

*Screening vehicle, by weight, 39% butyl methacrylate, and 61% butyl carbitol acetate.

EXAMPLE IV

Batches of resistor material were made using grade SGV-4 tantalum particles to produce tantalum nitride ($Ta_2N$) particles in the same manner as described in EXAMPLE I, except that particles of boron were included with the glass frit and the tantalum nitride ($Ta_2N$) particles in the amount shown in Table IV, and the glass frit has a composition by weight of 2.2% calcium oxide (CaO), 10.4% magnesium oxide (MgO), 14.4% aluminum oxide ($Al_2O_3$), 29% boron oxide ($B_2O_3$), and 44% silica ($SiO_2$). Resistors were made from the resistor materials in the manner described in EXAMPLE I. The resistors were also subject to a 175° C. No Load test. The results of testing the resistors are shown in Table IV.

TABLE IV

| | | | | | | | |
|---|---|---|---|---|---|---|---|
| Conductive Phase (volume %) | 20 | 20.5 | 21 | 22 | 25 | 27 | 30 |
| Tantalum Nitride ($Ta_2N$) (weight %) | 57 | 58 | 59 | 61 | 63 | 65 | 69 |
| Boron (weight %) | 1.6 | 1.6 | 1.5 | 1.5 | 1.4 | 1.4 | 1.3 |
| Resistance (ohms/square) | 3500 | 2400 | 860 | 580 | 100 | 40 | 28 |
| Temperature coeff. of Resistance (PPM/°C.) | | | | | | | |
| +150° C. | ∓22 | −117 | 63 | 57 | 120 | 137 | 165 |
| −55° C. | ±33 | −91 | 76 | 73 | 136 | 152 | 160 |
| 175° C. No Load (% change in Resistance) | | | | | | | |
| 24 hours | .4 | .3 | 1.1 | 1.1 | .1 | — | .1 |
| 360 hours | 1.1 | .8 | 3.7 | 3.9 | .3 | — | .4 |

EXAMPLE V

Batches of resistor material were made using grade SGQ-2 tantalum particles to produce tantalum nitride ($Ta_2N$) particles in the same manner as described in EXAMPLE IV, and they contained the amounts of tantalum nitride ($Ta_2N$) and boron shown in Table V, and the terminations on certain of the substrates were made of the nickel glaze designated CERMALLOY Ni 7328 of Bala Electronics Corp., West Conshohocken, Pennsylvania, fired at 1000° C. Resistors were made from the batches of resistor materials in the same manner as described in EXAMPLE I, and the results of testing the resistors are shown in TABLE V.

TABLE V

| | | |
|---|---|---|
| Conductive Phase (volume %) | 40 | 40 |
| Tantalum Nitride ($Ta_2N$) (weight %) | 78 | 78* |
| Boron (weight %) | 1.1 | 1.1 |
| Resistance (ohms/square) | 11 | 8 |
| Temperature coeff. of Resistance (PPM/°C.) | | |

TABLE V-continued

| | | |
|---|---|---|
| +150° C. | 159 | 157 |
| −55° C. | 187 | 186 |

*Terminated with nickel glaze.

EXAMPLE VI

Batches of resistor material were made using grade SGV-4 tantalum particles to produce tantalum nitride ($Ta_2N$) particles in the same manner as described in EXAMPLE V, except that they contained tantalum nitride ($Ta_2N$) and boron in the amounts shown in Table VI. Resistors were made from the resistor materials in the manner described in EXAMPLE I. The results of testing the resistors are shown in Table VI.

TABLE VI

| | | | | |
|---|---|---|---|---|
| Conductive Phase (volume %) | 20 | 20 | 20 | 20 |
| Tantalum Nitride ($Ta_2N$) (weight %) | 57 | 57* | 57 | 57 |
| Boron (weight %) | 0 | 1 | 1.6 | 2.5 |
| Resistance (ohms/square) | 10M | 4800 | 4700 | 6100 |
| Temperature coeff. of Resistance (PPM/°C.) | | | | |
| +150° C. | — | −341 | −126 | −233 |
| −55° C. | — | −183 | −82 | −216 |

*Terminations made of CERAMALLOY Ni 7328 nickel glaze.

EXAMPLE VII

Batches of resistor material were made using grade SGV-4 tantalum particles to produce tantalum nitride ($Ta_2N$) particles in the same manner as described in EXAMPLE I, except that particles selected from tantalum, nickel, silicon, zirconia ($ZrO_2$) and magnesium zirconate ($MgZrO_3$) were included with the glass frit and the particles of tantalum nitride ($Ta_2N$) in the amount shown in Table VII. Resistors were made from the resistor materials in the manner described in EXAMPLE I. The results of testing the resistors are shown in Table VII.

TABLE VII

| | | | | | | | | |
|---|---|---|---|---|---|---|---|---|
| Conductive Phase (volume %) | 10.5 | 10.5 | 18 | 20 | 20 | 25 | 12 | 12 |
| Tantalum Nitride ($Ta_2N$) (weight %) | 36* | 36 | 32* | 28* | 34 | 39 | 39** | 39* |
| Tantalum (weight %) | — | — | 21 | 28 | 20 | 22 | — | — |
| Nickel (weight %) | — | — | 0.8 | 0.3 | — | — | — | — |
| Silicon (weight %) | 0.7 | 0.7 | — | — | — | — | — | — |
| Zirconia ($ZrO_2$) (weight %) | — | — | — | — | — | — | 11 | — |
| Magnesium Zirconate ($MgZrO_3$) (weight %) | — | — | — | — | — | — | — | 11 |
| Resistance (ohms/square) | 10K | 3300 | 6700 | 390 | 2700 | 360 | 5800 | 5100 |
| Temperature coeff. of Resistance | | | | | | | | |

TABLE VII-continued

| | | | | | | | | |
|---|---|---|---|---|---|---|---|---|
| (PPM/°C.) | | | | | | | | |
| +150° C. | 430 | 360 | −159 | 178 | 133 | 220 | −78 | −124 |
| −55° C. | 522 | 402 | −119 | 209 | 188 | 342 | −130 | −214 |

*Screening vehicle, by weight, 39% butyl methacrylate, and 61% butyl carbitol acetate.
**Resistor glaze fired at 1050° C.

From the above Examples, there can be seen the effects on the electrical characteristics of the resistor of the present invention of variations in the composition of the resistor material and the method of making the resistor. Examples I, II, and III show the effects of varying the ratio of the conductive phase of tantalum nitride ($Ta_2N$) and the glass frit, while the Examples II and III also show the effect of the nitriding temperature used in producing the tantalum nitride ($Ta_2N$) particles. Examples IV, V and VI show the effects of adding boron to the conductive phase, while Example VII shows the effect of adding tantalum, nickel, silicon, zirconia ($ZrO_2$) or magnesium zirconate ($MgZrO_3$). The effects of terminating the resistors by copper and nickel glaze compositions are shown particularly by Examples V and VI, and all of the Examples show the relatively high stability provided by the resistors for copper and nickel terminations. The stability of the resistor is also shown by the temperature coefficient of resistance provided within approximately ±300 parts per million per °C., and the temperature coefficients of resistance provided within approximately ±200 parts per million per °C. for tantalum nitride ($Ta_2N$) particles with certain additive particles. Changes in resistance ($\Delta R$) under no load testing for up to 360 hours at 175° C. are shown in Example IV and were as low as 0.3% and less than 4%. The tables also show the wide range of resistivities and low resistivities provided by the invention ranging from about 8 ohms/square to about 9000 ohms/square while still providing high stability. The resistors of the invention, thus, can be made of inexpensive material for providing varying resistivities with high temperature stability, while also permitting their termination by inexpensive materials of copper and nickel.

It will thus be seen that the objects set forth above, among those made apparent from the preceding description, are efficiently obtained, and since certain changes may be made without departing from the scope of the invention, it is intended that all matter contained in the above description shall be interpreted as illustrative and not in a limiting sense.

What is claimed is:

1. A resistor material consisting essentially of a mixture of a glass frit and particles of tantalum nitride ($Ta_2N$).

2. A resistor material in accordance with claim 1 in which the tantalum nitride is present in the amount of about 29% to 78% by weight.

3. A resistor material comprising a mixture of a glass frit, particles of tantalum nitride ($Ta_2N$), and additive particles, said additive particles being selected from the group consisting of boron, tantalum, silicon, zirconium dioxide ($ZrO_2$), and magnesium zirconate ($MgZrO_3$).

4. A resistor material in accordance with claim 3 in which the tantalum nitride particles are present in the amount of about 29% to 78% by weight.

5. A resistor material in accordance with claim 4 in which the additive particles are present in an amount of up to approximately 100% by weight of the tantalum nitride particles.

6. An electrical resistor comprising a ceramic substrate and a resistor material on a surface of said substrate, said resistor material comprising a film of glass containing an effective amount of conductive particles of tantalum nitride ($Ta_2N$) embedded in and dispersed throughout the glass.

7. An electrical resistor in accordance with claim 6 in which the resistor material contains about 29% to 78% by weight of the tantalum nitride.

8. An electrical resistor comprising a ceramic substrate and a resistor material on a surface of said substrate, said resistor material comprising a film of glass and particles of tantalum nitride ($Ta_2N$) and additive particles embedded in and dispersed throughout the glass film, said additive particles being selected from the group consisting of boron, tantalum, silicon, zirconium dioxide ($ZrO_2$), and magnesium zirconate ($MgZrO_3$).

9. An electrical resistor in accordance with claim 7 in which the resistor material contains about 29% to about 78% by weight of the tantalum nitride.

10. An electrical resistor in accordance with claim 9 in which the additive particles are present in an amount of up to approximately 100% by weight of the tantalum nitride.

11. A method of making an electrical resistor comprising the steps of mixing together a glass frit and particles consisting essentially of tantalum nitride ($Ta_2N$), coating the mixture onto the surface of a substrate of an electrical insulating material, firing said coated substrate in a substantially inert atmosphere at a temperature at which the glass frit melts, and then cooling said coated substrate.

12. The method in accordance with claim 11 in which the mixture contains about 29% to 78% by weight of the tantalum nitride.

13. The method in accordance with claim 12 in which the additive particles are present in an amount of up to approximately 100% by weight of the tantalum nitride.

14. The method in accordance with claim 11 including the step of preparing the tantalum nitride ($Ta_2N$) by heat treating tantalum particles in a nitrogen atmosphere.

15. The method in accordance with claim 14 in which the tantalum particles are heat treated by heating up to a maximum temperature within the range of 600° C. to 1000° C. for a one hour cycle.

16. A method of making an electrical resistor comprising the steps of mixing together a glass frit, and particles of tantalum nitride ($Ta_2N$) and of an additive material selected from the group consisting of boron, tantalum, silicon, zirconium dioxide ($ZrO_2$), and magnesium zirconate ($MgZrO_3$), coating the mixture onto the surface of a substrate of an electrical insulating material, firing said coated substrate in a substantially inert atmosphere at a temperature at which the glass frit melts, and then cooling said coated substrate.

17. The method in accordance with claim 16 in which the tantalum particles are present in the amount of 29% to 78% by weight of the tantalum nitride.

18. The method in accordance with claim 16 in which the additive particles are present in an amount of up to approximately 100% by weight of the tantalum nitride.

19. The method in accordance with claim 16 including the step of preparing the tantalum nitride ($Ta_2N$) by heat treating tantalum particles in a nitrogen atmosphere.

20. An electrical resistor made by the steps of mixing together a glass frit and particles consisting essentially of tantalum nitride ($Ta_2N$), coating the mixture onto the surface of a substrate of an electrical insulating material, firing said coated substrate in a substantially inert atmosphere at a temperature at which the glass frit melts, and then cooling said coated substrate.

21. An electrical resistor made in accordance with claim 20 in which the mixture contains 29% to 78% by weight of the tantalum nitride.

22. An electrical resistor made in accordance with claim 15 in which the additive particles are present in an amount of up to approximately 100% by weight of the tantalum nitride.

23. An electrical resistor made by the steps of mixing together a glass frit, and particles of tantalum nitride ($Ta_2N$) and of an additive material selected from the group consisting of boron, tantalum, silicon, zirconium dioxide ($ZrO_2$), and magnesium zirconate ($MgZrO_3$), coating the mixture onto the surface of a substrate of an electrical insulating material, firing said coated substrate in a substantially inert atmosphere at a temperature at which the glass frit melts, and then cooling said coated substrate.

24. An electrical resistor made in accordance with claim 23 in which the tantalum nitride particles are present in the amount of 29% to 78% by weight.

25. An electrical resistor made in accordance with claim 24 in which the additive particles are present in an amount up to approximately 100% by weight of the tantalum nitride.

* * * * *